United States Patent [19]

Menge

[11] Patent Number: 4,998,299

[45] Date of Patent: Mar. 12, 1991

[54] TOILET WITH APPARATUS FOR EVACUATING MALODOROUS AIR FROM THE BOWL

[76] Inventor: Heinrich Menge, Pferdeweg 45, D-2100 Hamburg 36, Fed. Rep. of Germany

[21] Appl. No.: 491,478

[22] Filed: Mar. 6, 1990

[30] Foreign Application Priority Data

Mar. 7, 1989 [DE] Fed. Rep. of Germany ..... 3907214

[51] Int. Cl.[5] ..... E03D 9/52

[52] U.S. Cl. ..... 4/349; 4/213

[58] Field of Search ..... 4/213, 216, 306, 328, 4/349, 214, 215; 137/247.25, 247.33, 251.1

[56] References Cited

U.S. PATENT DOCUMENTS

| | | | |
|---|---|---|---|
| 288,573 | 11/1883 | Hyde | 137/247.25 X |
| 516,011 | 3/1894 | Harvey | 4/328 |
| 680,380 | 8/1901 | Hyde | 137/247.25 X |
| 1,303,974 | 5/1919 | Shadall | 4/215 |
| 3,740,771 | 6/1973 | Bond | 4/215 |
| 3,781,923 | 1/1974 | Maisch et al. | 4/213 |
| 4,318,192 | 3/1982 | Williams et al. | 4/213 |
| 4,800,596 | 1/1989 | Menge | 4/348 |
| 4,880,027 | 11/1989 | Menge | 137/247.25 |
| 4,933,996 | 6/1990 | Sowards | 4/213 |

FOREIGN PATENT DOCUMENTS

| | | | |
|---|---|---|---|
| 2114778 | 8/1979 | Fed. Rep. of Germany | 4/213 |

*Primary Examiner*—Henry J. Recla
*Assistant Examiner*—Robert M. Fetsuga
*Attorney, Agent, or Firm*—Peter K. Kontler

[57] ABSTRACT

A toilet wherein the bowl is connected with the lower end of a flushing tank by a conduit which also serves for evacuation of malodorous air prior to flushing. The valve which can be opened to admit flushing liquid into the bowl has a valving element at the lower end of a duct which communicates with the conduit and the upper end of which is located above the level of flushing liquid in the tank. The apparatus for evacuating malodorous air has a pipe which is installed in the duct and has an intake above the liquid level as well as an outlet extending through and outwardly from the bottom wall of the tank. An odor barrier in the tank can seal or establish a path for the flow of air from the bowl by way of the conduit and duct and into the intake of the pipe so that a fan which is installed at the outlet of the pipe can draw air from the pipe and convey it into a flue. The odor barrier has a liquid containing vessel surrounding the intake of the pipe and being carried by the upper end of the duct, a vertically movable cap which normally dips into the liquid in the vessel and sealingly engages the intake of the pipe, a mechanism which can raise the cap, and a bell which dips into the supply of liquid in the tank and defines a compartment for the cap and the vessel.

31 Claims, 1 Drawing Sheet

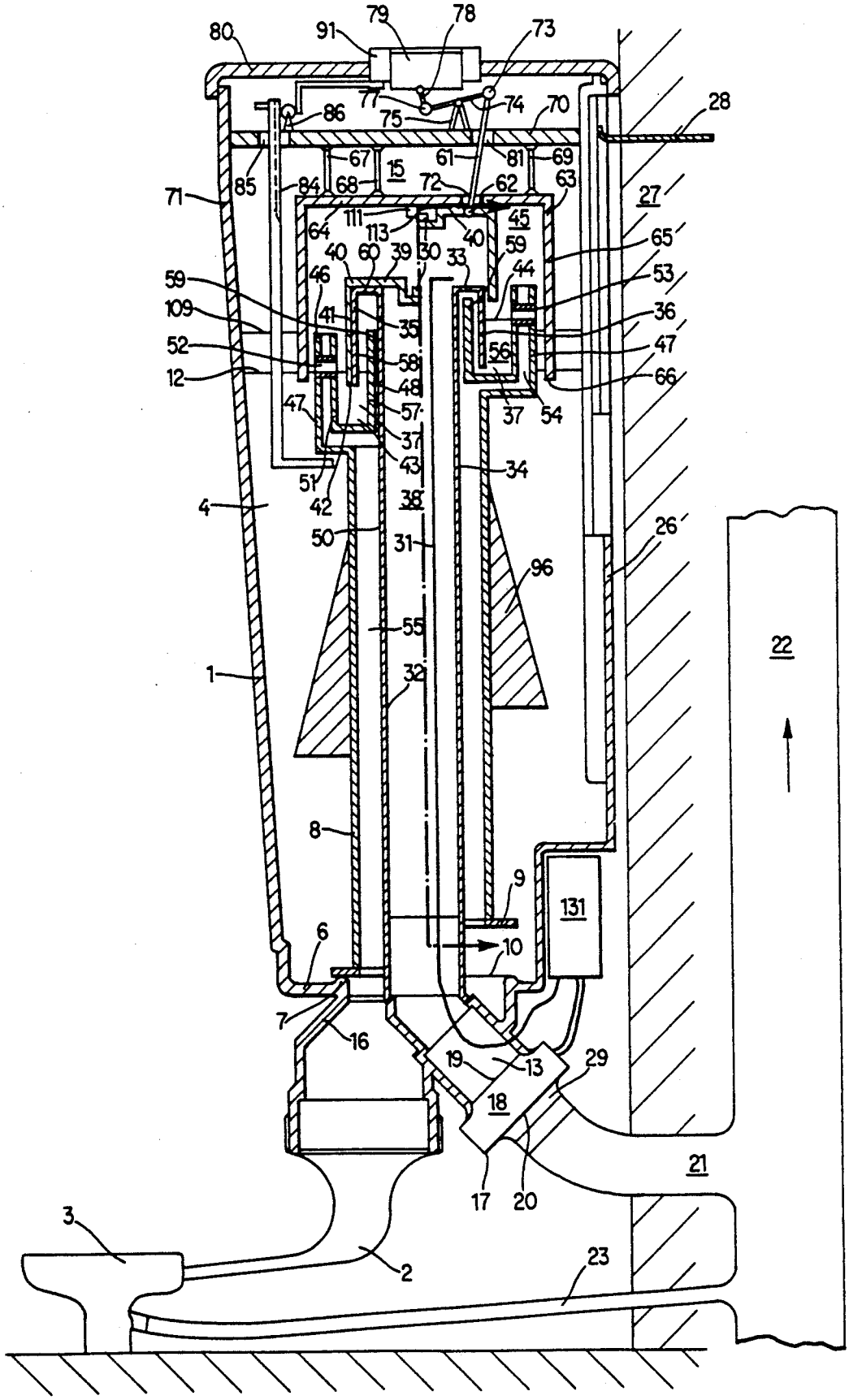
80
91
79
78
73
77
74
70
28
86
75
67
15
61
81
69
85
84
68
72
62
63
71
27
111
45
64
113
40
65
40
60
39
30
33
59
59
46
44
53
109
41
35
36
52
58
56
47
12
48
66
47
57
37
54
37
43
34
51
42
38
4
50
31
26
96
55
22
1
32
8
9
131
6
10
7
16
19
13
29
18
21
17
20
3
2
23

TOILET WITH APPARATUS FOR EVACUATING MALODOROUS AIR FROM THE BOWL

BACKGROUND OF THE INVENTION

The invention relates to toilets with flushing tanks in general, and more particularly to improvements in so-called ventilated toilets with apparatus for evacuating malodorous air from the bowl. Ventilated toilets of the type to which the present invention pertains are disclosed, for example, in commonly owned U.S. Pat. Nos. 4,800,596 and 4,880,027.

It is already known to evacuate foul smelling air from the bowl of a toilet by way of the flushing tank and to provide in the flushing tank a so-called odor barrier which prevents escape of malodorous air from the tank. It is also known to provide in the tank a duct which serves to receive malodorous air from the bowl, and to establish a odor barrier between such duct and the means for conveying air from the duct to a flue or the like. An advantage of an odor barrier which is installed in the tank is that the supply of flushing liquid in the tank can be used as an element of the odor barrier. The aforementioned duct can constitute a component of the means for opening and closing the valve which serves to admit flushing liquid into the bowl, i.e., this duct can serve several purposes. Such toilets are quite satisfactory because their odor evacuating apparatus can effectively prevent the escape of foul smelling air into the surrounding atmosphere. A drawback of presently known toilets of the above outlined character is that the odor barrier and certain other parts of the air evacuating apparatus are bulky, complex and expensive.

OBJECTS OF THE INVENTION

An object of the invention is to provide a novel and improved apparatus for evacuating malodorous air from the bowl of a toilet by way of the flushing tank.

Another object of the invention is to provide a novel and improved odor barrier for use in the above outlined apparatus.

A further object of the invention is to provide a novel and improved operative connection between the valve-operating duct in the flushing tank and other parts of the evacuating apparatus.

An additional object of the invention is to provide a simple, compact and inexpensive but reliable air evacuating apparatus which can be confined in standard-size flushing tanks.

Still another object of the invention is to provide a novel and improved valve for admission of flushing liquid into the bowl of a toilet embodying the above outlined evacuating apparatus.

A further object of the invention is to provide novel and improved means for lifting the odor barrier during evacuation of air from the bowl.

SUMMARY OF THE INVENTION

The improved toilet comprises a bowl, means for discharging waste from the bowl, a refillable tank for a supply of flushing liquid which normally fills the tank to a predetermined level, combined liquid-admitting and odor-evacuating conduit means connecting the tank with the bowl, a normally closed valve which is provided in the tank to seal the conduit means from the supply of flushing liquid, user-operated means for opening the valve including a duct having a first end in communication with the conduit means and a second end in the tank above the liquid level. The user-operated means further comprises means for displacing the duct relative to the tank to thereby open the valve, and the toilet further comprises means for evacuating malodorous air from the bowl. The evacuating means includes a pipe having an intake in the tank above the liquid level adjacent the second end of the duct and an outlet outside of the tank. The evacuating means further comprises means for drawing air from the bowl by way of the duct and the pipe, a liquid-containing odor barrier between the second end of the duct and the intake of the pipe, and means for lifting or deactivating the odor barrier to thus establish a path for the flow of air from the bowl into the outlet of the pipe.

The duct is or can be substantially parallel to the pipe, and the intake can constitute the upper end of the pipe. The duct is or can be substantially vertical so that its second end is the upper of the two ends.

The odor barrier preferably comprises a substantially bell-shaped member (hereinafter called bell for short) which overlies and confines the upper ends of the duct and pipe. The lower marginal portion of the bell is disposed beneath the level of the liquid supply in the tank, and the bell defines a compartment which is disposed above the liquid level and establishes communication between the upper ends of the pipe and duct in lifted condition of the odor barrier.

In accordance with a presently preferred embodiment, the duct surrounds the pipe in the interior of the tank. The outlet of the pipe extends from the tank in the region of the bottom wall of the tank. Such bottom wall can include a nipple which connects the tank with the conduit means, and the pipe preferably extends from the tank by way of the nipple. The valve can include a seat which forms part of the nipple, and a valving element which is provided at the first end of the duct and engages the seat in closed position of the valve.

The means for drawing air from the bowl preferably comprises a fan having a suction side which is connected with the intake of the pipe and a pressure side connected with a flue for malodorous air by way of the outlet.

The odor barrier (including the aforementioned bell) is preferably disposed in the tank and preferably further comprises a liquid-containing vessel which surrounds the pipe, and a cap which overlies the intake of the pipe and dips into the body of liquid in the vessel and is spacedly surrounded by the second end of the duct. The lifting means of the odor barrier can include means for moving the cap above and away from the intake and out of the body of liquid in the vessel to thus establish the aforementioned path for the flow of malodorous air from the bowl into the outlet of the pipe. The moving means can include means for moving the cap substantially longitudinally of the pipe. An end wall of the cap sealingly engages the intake of the pipe when the cap dips into the body of liquid in the vessel. The bell of the odor barrier confines the cap, and the aforementioned compartment of the bell establishes communication between the intake of the pipe and the upper end of the duct when the cap is moved above and away from the intake and out of the body of liquid in the vessel.

A portion of the moving means can extend through the bell, preferably through a top wall of the bell. Such top wall is then provided with an opening for the aforementioned portion of the moving means and the opening contains means for sealing the opening around such portion of the moving means. The vessel is or can be rigid (e.g., integral) with the upper end of the duct. Such vessel can include an annular inner wall which surrounds the pipe in the region of the intake, and an outer wall which is rigid with the upper end of the duct. The outer wall can constitute a twin wall with an inner jacket which spacedly surrounds the inner wall and an outer jacket which spacedly surrounds the inner jacket and is integral with the upper end of the duct. At least one open-ended connector (e.g., a connector having a short tube) can be provided between the two jackets of the vessel, and at least a portion of such connector or connectors is disposed beneath the level of the supply of liquid in the tank in closed position of the valve to admit liquid from the supply in the tank into the vessel.

The intake of the pipe can include a sleeve which has a lower portion dipping into the body of liquid in the vessel. Such intake preferably further includes a tubular portion which is spacedly surrounded by the sleeve. The aforementioned annular inner wall of the vessel is disposed between the tubular portion and the sleeve of the intake of the pipe. Means can be provided to separably connect the tubular portion of the intake with the sleeve.

The upper end of the annular inner wall of the vessel is preferably disposed at a level at least close to the level of the second or upper end of the duct, and such upper end of the inner wall abuts the intake in open position of the valve. When the valve is closed, the upper end of the inner wall of the vessel is disposed beneath the intake and beneath the maximum permissible level of the supply of liquid in the tank.

The means for moving the cap of the odor barrier can include a manually operable component (e.g., a knob) which is accessible at the exterior of the tank. For example, the manually operable component of the moving means can be accessible at the upper side of a cover which constitutes a preferably detachable part of the tank, and such component can be mounted for movement in a direction toward the interior of the tank.

The opening means preferably also includes a manually operable component which is mounted in and is accessible at the exterior of the cover. The toilet can further comprise means for varying the duration of opening of the valve, i.e., for selecting the quantity of flushing liquid which can leave the tank in order to enter the bowl by way of the conduit means while the valve is maintained in open position.

The novel features which are considered as characteristic of the invention are set forth in particular in the appended claims. The improved toilet itself, however, both as to its construction and the method of operating the same, together with additional features and advantages thereof, will be best understood upon persual of the following detailed description of certain presently preferred specific embodiments with reference to the accompanying drawing.

BRIEF DESCRIPTION OF THE DRAWING

The single Figure of the drawing is a somewhat schematic partly elevational and partly vertical sectional view of a toilet which embodies one form of the invention, one-half of the valving element of the valve being shown in open position and one-half of the odor barrier being shown in lifted position.

DESCRIPTION OF PREFERRED EMBODIMENTS

The toilet which is shown in the drawing comprises a bowl 3 having an outlet connected with a waste discharging line 23. The toilet further comprises a refillable flushing tank 1 having a bottom wall 6 with a nipple 16 connected with the bowl 3 by a conduit 2 which serves to admit flushing liquid in response to opening of a normally closed valve 7 as well as to permit evacuation of malodorous air from the bowl 3 while the toilet is in use. The tank 1 normally contains a supply 4 of flushing liquid (such as water) which fills the tank to a level 12 but can rise at times above such level to a maximum permissible level 109.

The valve 7 includes an annular seat 10 which can constitute an integral part of the bottom wall 6 and/or its nipple 16, and a valving element 9 provided at the lower end of an elongated upright duct 8 the upper end of which is shown at 46. The duct 8 serves to raise and lower the valving element 9 relative to the seat 10 and further constitutes a part of an apparatus which serves to evacuate malodorous air from the bowl 3 and into a flue 22 extending upwardly from a waste line serving to receive waste from the line 23. The upper end 46 of the duct 8 is located at least slightly above the level 12 of flushing liquid in the tank 1 irrespective of the axial position of the duct, i.e., in open and closed positions of the valve 7.

The nipple 16 is integral with the lower end or outlet 13 of an upright pipe 32 which is coaxial with and spaced apart from and is surrounded by the duct 8 and constitutes a second part of the air evacuating apparatus. The outlet 13 of the pipe 32 extends outwardly beyond the bottom wall 6 of the tank 1 and contains a fan 18 constituting a means for actually drawing air from the bowl 3 and having a suction side 19 connected with the major part of the pipe 32 and a pressure side 20 serving to discharge air into a coupling at the adjacent end of a conduit or line 21 which admits foul smelling air into the flue 22. The reference character 29 denotes an electric motor which serves to drive the fan 18 and can be started in response to lifting of a cap-shaped member 39 (hereinafter called cap) of an odor barrier in the tank 1 to draw air from the bowl 3 by way of the conduit 2, nipple 16, duct 8, lifted or deactivated odor barrier in the tank 1 and pipe 32. The motor 29 and the fan 18 are installed in a common housing or casing 17 at the outlet 13 of the pipe 32.

In addition to the bottom wall 6, the tank 1 comprises an upright front wall 71, two sidewalls, a detachable top wall or cover 80 and a rear wall 26 which latter is preferably separably connected to the adjacent wall 27 of the toilet room by one or more hook-shaped and/or otherwise configurated coupling members 28. The internal space of the tank 1 is shown at 15; the lower portion of this space is normally filled by the supply 4 of flushing liquid. The manner of refilling the tank 1 subsequent to each opening of the valve 7 is known, and the means for admitting such liquid from a water supplying main or from another suitable source is not shown in the drawing. Reference may be had to the commonly owned U.S. Pat. Nos. 4,800,596 and 4,880,027.

The means for starting and arresting the motor 29 for the fan 18 comprises a normally open switch in the space 15 and a conductor 31 which connects the switch with a control unit 131 for the motor 29. The control unit 131 is installed between the wall 27 and the recessed lower portion of the wall 26. The switch comprises a relay 30 on the aforementioned cap 39 of the odor barrier and a magnet 111 which is secured to the underside of the end wall or top wall 64 of a bell-shaped member 63 (hereinafter called bell) of the odor barrier. The bell 63 defines a compartment 45 above the liquid level 12, and the lower marginal portion 66 of its skirt 65 dips into the supply 4 of flushing liquid in the lower portion of the tank 1. The compartment 45 receives the upper end 46 of the duct 8 as well as the intake or upper end 33 of the pipe 32.

The conductor 31 is confined in an insulating sheath and extends from the relay 30 through the internal space 38 of the pipe 32 all the way to the outlet 13 and thence to the control unit 131. The arrangement is such that, when the cap 39 of the odor barrier is lifted in the compartment 45 of the bell 63 to a certain level, the relay 30 moves sufficiently close to the magnet 111 to generate a signal which is transmitted via conductor 31 to start the motor 29 so that the fan 18 can draw malodorous air from the bowl 3 because the odor barrier including the fixedly mounted bell 63 and the vertically movable cap 39 is lifted or ineffective. The means for lifting or deactivating the odor barrier includes a mechanism which can move the cap 39 up and down in the axial direction of the pipe 32.

The duct 8 can constitute an upright cylinder, the same as the pipe 32, and the pipe 32 is preferably concentric with the duct. The outlet 33 of the pipe 32 includes a sleeve 36 which spacedly surrounds a tubular portion 34 of the pipe 32 and is preferably separably connected thereto by a washer-like top wall 60. The tubular portion 34, the top wall 60 and the sleeve 36 together constitute a ring-shaped hood 35 having an inverted U-shaped cross-sectional outline with the sleeve 36 spacedly surrounding an inner annular wall 48 of a vessel 37 constituting a further element of the odor barrier. The vessel 37 comprises an outer annular wall having an inner jacket 51 and an outer jacket 47 constituted by the uppermost portion of the duct 8, i.e., by that portion which includes the upper end 46.

The vessel 37 contains a body 43 of liquid which establishes a seal between the internal space 38 of the pipe 32 and the internal space 15 of the tank 1. The end wall or top wall 40 of the cap 39 abuts and sealingly engages the top wall 60 of the intake 33 in the lowered position of the cap (shown in the left-hand portion of the drawing). However, when the cap 39 is lifted (the right-hand portion of the cap 39 is shown in raised position), it establishes a path for the flow of malodorous air from the upper end 46 of the duct 8 (between the jackets 47 and 51 of the outer annular wall at the upper end of the duct), above the upper level 44 of the body 43 of liquid in the vessel 37, beneath the skirt 41 of the lifted cap 39 and into the intake 33 of the pipe 32 to be withdrawn by way of the outlet 13 because the motor 29 for the fan 18 is on in the raised position of the cap 39. The lowermost portion 42 of the skirt 41 dips into the body 43 of liquid in the vessel 37 when the cap 39 reassumes its lower end position of rest on the top wall 60 of the intake 33 so that the odor barrier including the parts 37, 39, 63 is again effective to seal the internal space 55 of the duct 8 from the internal space 38 of the pipe 32.

It is to be noted that, as a rule, the cap 39 constitutes a one-piece member, i.e., the right-hand portion of this cap is actually integral with the left-hand portion. The end wall or top wall 40 of the cap 39 has a recess 113 for the relay 30 of the switch which further includes the magnet 111 at the underside of the end wall or top wall 64 of the bell 63.

The outer jacket 47 of the outer annular wall of the vessel 37 constitutes a radially outwardly enlarged upper end portion of the duct 8. This outer jacket spacedly surrounds the inner jacket 51 which, in turn, spacedly surrounds the inner annular wall 48 of the vessel 37. The wall 48 and the inner jacket 51 are connected to each other by a bottom wall to define an annular chamber confining the body 43 of liquid for the lowermost portion 42 of the skirt 41 when the cap 39 is maintained in the lower end position to have its end wall 40 sealingly engage the top wall 60 of the intake 33. The internal surface 57 of the inner wall 48 is or can be concentric with the external surface 50 of the duct 8.

A connector 52 between the jackets 47, 51 of the outer annular wall of the vessel 37 comprises one or more (preferably several) equidistant open-ended tubes 53 which are located, at least in part, at the level 12 of the upper surface of the supply 4 of flushing liquid in the tank 1 to permit liquid which forms the supply 4 to flow into the vessel 37 and to replenish (when necessary) the body 43 of liquid between the inner jacket 51 and the inner wall 48, e.g., to compensate for evaporation of liquid from the vessel 37. The annular clearance 54 between the jackets 47, 51 of the outer wall of the vessel 37 is established and maintained by the tubes 53 of the connector 52 and constitutes a portion of the path for the flow of malodorous air from the internal space 55 of the duct 8 into the internal space 38 of the pipe 32 in raised position of the cap 39. The clearance 54 enables the internal space 55 to communicate with the compartment 45 of the bell 63, but this compartment is sealed from the internal space 38 of the pipe 32 as long as the marginal portion 42 of the skirt 41 of the cap 39 dips into the body 43 of liquid in the vessel 37. The number of tubes 53 preferably exceeds two so that such tubes can establish a stable and reliable connection between the jackets 47, 51 and can properly center the parts 48, 51 of the vessel 37 in the enlarged upper end portion or jacket 47 of the duct 8. The reference character 56 denotes the annular chamber which is defined by the vessel 37 and receives the body 43 of liquid. Such body can be said to form part of the odor barrier. The tubes 53 extend (at least in part) below the liquid level 12 in the tank 1 when the valve 7 is closed, i.e., when the duct 8 is maintained in the lower end position to urge the valving element 9 against the seat 10. Such lower end position of one-half of the duct 8 and valving element 9 is shown in the right-hand portion of the drawing. The tubes 53 further compensate for losses which develop as a result of repeated lifting of the skirt 41 of the cap 39 above and out of the body 43 of liquid in the vessel 37.

The upper end 59 of the inner wall 48 of the vessel 37 extends above the liquid level 12 in each end position of the duct 8. This inner wall 48 is disposed in the annular space 58 between the sleeve 36 and the tubular portion 34 of the intake 33 of the pipe 32. The upper end 59 abuts or is very closely adjacent the underside of the top wall 60 of the intake 33 in raised position of the duct 8, i.e., when the valve 7 is open. The level 109 of the upper end 46 of the duct 8 in closed position of the valve 7 constitutes the maximum permissible level of the supply 4 of liquid in the tank 1. If the supply 4 rises above the level 109, the surplus of liquid overflows into the annular clearance 54 and thence through the internal space 55 into the conduit 2 and bowl 3. This safety feature ensures that the tank 1 cannot be overfilled to flood the toilet room even if the event of failure of the means for refilling the tank 1 after each opening of the valve 7.

The means for lifting the cap 39 toward and, if necessary, all the way against the underside of the end wall 64 of the bell 63 comprises a depressible component in the form of a knob 79 which is accessible at the exposed side of the cover 80, and a mechanism which operatively connects the knob 79 with the top wall 40 of the cap 39. The mechanism includes an elongated link 61 the lower end portion of which is articulately connected to the top wall 40 by a joint 62. A median portion of the link 61 extends through an opening which is provided in the top wall 64 of the bell 63 and contains a sealing element 72 surrounding and sealingly engaging the link 61. The skirt 65 of the bell 63 is preferably concentric with the enlarged upper end portion or jacket 47 of the duct 8 and with the skirt 41 of the cap 39. As mentioned above, the lower marginal portion 66 of the skirt 65 dips into the supply 4 of liquid in the tank 1 when such supply rises to the level 12. The top wall 64 of the bell 63 is affixed to a horizontal traverse or crossbeam 70 in the internal space 15 of the tank 1 by several upright anchoring members 67, 68, 69. The ends of the crossbeam 70 are connected with and stiffen the walls 26 and 71 of the tank 1. Since the marginal portion 66 of the skirt 65 dips into the supply 4 of liquid when the valve 7 is closed, the unfilled upper portion of the internal space 15 of the tank 1 is then sealed from the compartment 45 within the bell 63.

The upper end of the link 61 is articulately connected (at 73) to one arm of a two-armed lever 74 which is fulcrumed on the crossbeam 70, as at 75. The other arm of the lever 74 is articulately connected (at 77) with a link 78 which couples the lever with the depressible knob 79. The illustrated knob 79 is mounted for movement substantially vertically toward and away from the internal space 15 of the tank 1. The cover 80 is or can be disposed in a substantially horizontal plane in parallelism with and above the crossbeam 70. The knob 79 is shown in depressed position because the link 61 is attached to the raised right-hand portion of the cap 39. The crossbeam 70 has an opening 81 for a portion of the link 61.

When the knob 79 is depressed, it lifts the cap 39 toward the wall 64 of the bell 63 whereby the relay 30 approaches and is energized by the magnet 111 to transmit a signal via conductor 31 which causes the control unit 131 to start the motor 29 for the fan 18. At such time, the lower end 42 of the skirt 41 of the cap 39 is lifted above the upper level 44 of the body 43 of liquid in the vessel 37 so that the path for the flow of air from the bowl 3 into the outlet 13 of the pipe 32 is completed. The motor 29 can but need not be automatically arrested to deactivate the fan 18 when the cap 39 is caused or permitted to descend onto the top wall 60 of the intake 33. This reestablishes the odor barrier since the lower end 42 of the skirt 41 of the cap 39 then dips into the body 43 of liquid in the vessel 37 to seal the internal space 38 of the pipe 32 from the compartment 45 of the bell 63.

The control unit 131 can contain a time delay relay of any known design which completes the circuit of the motor 29 for a preferably adjustable preselected interval of time in response to lifting of the cap 39 to its raised position. Furthermore, the toilet preferably further comprises a preferably adjustable stop (not specifically shown) which is movable into frictional or other engagement with the knob 79, link 61 and/or cap 39 while the motor 29 is running to thus ensure that the path for the flow of air from the bowl 3 to the outlet 13 of the pipe 32 remains completed for the preselected interval of time (e.g., three minutes).

The means for opening the valve 7 includes the duct 8 as well as a mechanism for moving the duct between its upper and lower end positions. Such mechanism includes an elongated motion transmitting member 84 having a hook-shaped lower end portion which is adjacent the underside of enlarged upper end portion or outer jacket 47 of the duct 8. The member 84 extends upwardly through an opening 85 in the crosshead 70 and is operatively connected with a movable component 91 in the form of a depressible and turnable knob mounted in the cover 80, accessible at the exposed upper side of the cover and concentrically surrounding the knob 79. An adjustable time delay unit 86 is interposed between the turnable knob 91 and the upper end portion of the member 84 to select the interval of time during which the valve 7 remains open in response to depression of the knob 91.

If the user of the toilet or a maintenance person decides that a relatively small quantity of flushing liquid suffices to adequately flush the bowl 3 after a use, the knob 91 is rotated relative to a suitable scale at the exposed side of the cover 80 to assume a selected position which ensures that the unit 86 will prevent closing of the valve 7 (e.g., under the weight of the duct 8) prior to expiration of the preselected interval of time, i.e., depending on the selected angular position of the knob 91. The arrangement is or may be such that turning of the knob 91 about the knob 79 determines the extent to which the duct 8 is lifted in response to depression of the knob 91 and hence the quantity of flushing liquid which can descend into the bowl 3 through the valve 7 and conduit 2 while the duct 8 is maintained in raised position.

The duct 8 can carry a float 96 which exhibits a tendency to rise toward the level 12 and thus promotes or assists the upward movement of the duct during opening of the valve 7. The buoyancy of the float 96 is selected in such a way that it does not entail accidental opening of the valve 7.

The improved toilet is utilized as follows:

The user depresses the knob 79 prior to or during actual use of the toilet to lift the cap 39 (i.e., to open the odor barrier) and to start the motor 29 for a selected interval of time (as determined by setting of the time delay relay in the control unit 131). The fan 18 draws foul smelling air from the bowl 3 via conduit 2, nipple 6, duct 8, compartment 45 and pipe 32, and such air is conveyed into the flue 22 by way of the line 21.

The knob 91 is turned to or already assumes an angular position in which the valve 7 is set to discharge a preselected quantity of flushing liquid from the supply 4 via opened valve 7, nipple 16 and conduit 2. Actual opening of the valve 7 takes place in response to depression of the knob 91, i.e., the motion transmitting member 84 then lifts the duct 8 to move the valving element 9 above and away from the seat 10 of the valve 7.

The cap 39 descends to reestablish the odor barrier after elapse of the aforediscussed preselected interval of time, i.e., simultaneously with or immediately following stoppage of the motor 29 and fan 18. Thus, if the aforementioned stop for the knob 79, link 61 and/or cap 39 is retracted or deactivated, the cap 39 can descend by gravity to reintroduce its skirt 41 into the body 43 of liquid in the vessel 37 and to thus seal the internal space 38 of the pipe 32 from the compartment 45 of the bell 63, i.e., from the internal space 55 of the duct 8.

If a single lifting of the cap 39 does not suffice to evacuate malodorous air from the bowl 3, the user depresses the knob 79 for a second time and, if necessary, one or more additional times to restart the motor 29 for preselected intervals of time.

The delay with which the duct 8 closes the valve 7 is determined by the selected angular position of the knob 91, i.e., by selected setting of the time delay unit 86. The latter can be designed to select the rate of gravitational descent of the duct 8 from the raised position to the lower end position in which the valve 7 is closed.

The feature that the pipe 32 is parallel with and is preferably confined in the duct 8 simplifies the mounting of the pipe and particularly of its outlet 13 in the bottom wall 6 of the tank 1. In addition, the upper ends (46 and 33) of the duct 8 and pipe 32 are closely adjacent each other above the level 12 of the supply 4 of liquid in the tank 1. This renders it possible to simplify the odor barrier and to provide a compact odor barrier. That portion of the path for evacuation of malodorous air which extends between the upper end 46 of the duct 8 and the intake 33 of the pipe 32 is very short which reduces the likelihood of spreading of malodorous air in the internal space 15 of the tank 1. The odor barrier including the vessel 37, cap 39 and bell 63 is effective as soon as the evacuation of air from the bowl 3 is completed, and this also reduces the likelihood of penetration of air from the bowl 3 into the space 15 above the level 12 of the supply 4 of liquid in the tank 1.

The cap 39 and the bell 63 are preferably small so that they can receive relatively small quantities of air. This also reduces the likelihood of spreading of foul smelling air into the unoccupied upper portion of the internal space 15 and thence into the atmosphere around the tank 1. Moreover, when the motor 29 drives the fan 18 while the cap 39 is lifted, the fan is capable of evacuating the entire stream of foul smelling air which rises in the internal space 55 of the duct 8 and is free to flow into the intake 33 because the cap 39 is lifted so that its skirt 41 is located above the level 44 of liquid 43 in the vessel 37. In fact, the fan 18 is even likely to draw air from the internal space 15 rather than permitting malodorous air to flow from the internal space 45 into the internal space 15 while the level of the supply 4 of liquid in the tank 1 sinks as a result of opening of the valve 7.

Mounting of the pipe 32 in the duct 8 contributes to compactness of the air evacuating apparatus and of the odor barrier, i.e., the latter can employ a relatively small vessel 37, a relatively small cap 39 and a relatively small bell 63 because the intake 33 of the pipe 32 is surrounded by the upper end 46 of the duct 8. The need for relatively small parts of the odor barrier reduces the initial cost and weight of the parts 37, 39 and 63.

The feature that the bottom wall 6 of the tank 1 is provided with a nipple 16 which is connected with the conduit 2 as well as with the outlet 13 of the pipe 32 also contributes to simplicity, lower cost and compactness of the improved toilet. Thus, it is merely necessary to provide a single opening in the bottom wall 6, to provide a single seal between the nipple 16 and the conduit 2 and to provide a single seal between the outlet 13 (which is or can be integral with the nipple 16) and the line 21. The connection between the nipple 16 and the conduit 2 can include mating male and female threads, the same as the connection between the housing 17 for the motor 29 and the line 21. Such connections are disposed externally of the tank 1 so that they are readily accessible for inspection and repair.

The relatively small vessel 37 of the odor barrier need not store a large supply 43 of liquid because the cap 39 is small due to the fact that the intake 33 of the pipe 32 is surrounded by the upper end 46 of the duct 8. The lightweight cap 39 can be rapidly lifted or lowered with a minimum of effort.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A toilet comprising a bowl; means for discharging waste from said bowl; a refillable tank for a supply of flushing liquid which normally fills the tank to a predetermined level; combined liquid-admitting and odor-evacuating conduit means connecting said tank with said bowl; a normally closed valve provided in said tank to seal said conduit means from the supply of flushing liquid, said valve including a duct having a first end in communication with said conduit means and a second end in said tank above said level user-operated means for opening said valve including means for displacing said duct relative to said tank to thereby open said valve; and means for evacuating malodorous air from said bowl, including a pipe having an air intake in said tank above said level adjacent said second end of said duct and an outlet outside of said tank, means for drawing air from said bowl by way of said duct and said pipe, a liquid-containing odor barrier between said second end of said duct and said intake, said odor barrier comprising sealing means for sealing said intake, and means for lifting said sealing means to thus establish a path for the flow of air from said bowl into said outlet.

2. The toilet of claim 1, wherein said duct is substantially parallel to said pipe and said pipe has an upper end which constitutes said intake, said duct having an upper end which constitutes said second end thereof.

3. The toilet of claim 2, wherein said odor barrier further comprises a bell overlying and confining said upper ends, said bell having a lower marginal portion beneath said level and said bell defining a compartment which is disposed above said level and establishes communication between said upper ends in lifted condition of said sealing means.

4. The toilet of claim 2, wherein said duct surrounds said pipe.

5. The toilet of claim 4, wherein said tank includes a bottom wall and said pipe extends from said duct in the region of said bottom wall.

6. The toilet of claim 4, wherein said tank includes a bottom wall having a nipple which connects said tank with said conduit means, said pipe extending from said tank by way of said nipple.

7. The toilet of claim 6, wherein said valve includes a seat forming part of said nipple and a valving element which is provided on said duct and engages said seat in closed position of the valve.

8. The toilet of claim 2, wherein said means for drawing air includes a fan having a suction side connected with the intake of said pipe and being located externally of said tank.

9. The toilet of claim 8, further comprising a flue, said fan having a pressure side connected with said flue.

10. The toilet of claim 2, wherein said odor barrier is disposed in said tank.

11. The toilet of claim 10, wherein said odor barrier further comprises a liquid-containing vessel which surrounds said pipe and said sealing means includes a cap overlying said intake, dipping into the liquid in said vessel and being spacedly surrounded by the second end of said duct, said lifting means including means for moving said cap above and away from said intake and out of the liquid in said vessel to thus establish said path.

12. The toilet of claim 11, wherein said moving means includes means for moving said cap substantially longitudinally of said pipe.

13. The toilet of claim 11, wherein said cap has an end wall which sealingly engages the intake of said pipe when said cap dips into the liquid in said vessel.

14. The toilet of claim 13, wherein said odor barrier further comprises a bell which confines said cap and has a lower marginal portion beneath said level, said bell defining a compartment disposed above said level and establishing communication between the intake of said pipe and the upper end of said duct when said cap is moved above and away from said intake and out of the liquid in said vessel.

15. The toilet of claim 14, wherein said moving means includes a portion which extends through said bell.

16. The toilet of claim 15, wherein said bell has a top wall with an opening for said portion of said moving means, and further comprising means for sealing said opening around said portion of said moving means.

17. The toilet of claim 11, wherein said vessel is rigid with the upper end of said duct.

18. The toilet of claim 17, wherein said vessel includes an annular inner wall surrounding said pipe in the region of said intake.

19. The toilet of claim 18, wherein said vessel further includes an annular outer wall which is rigid with the upper end of said duct.

20. The toilet of claim 19, wherein said outer wall includes an inner jacket which spacedly surrounds said inner wall and an outer jacket which spacedly surrounds said inner jacket and is integral with the upper end of said duct.

21. The toilet of claim 20, further comprising at least one open-ended connector between said jackets, at least a portion of said connector being disposed beneath said level in closed position of said valve to admit liquid from the supply in said tank into said vessel.

22. The toilet of claim 11, wherein said intake includes a sleeve having a lower portion dipping into liquid in said vessel.

23. The toilet of claim 22, wherein said intake further comprises a tubular portion which is spacedly surrounded by said sleeve, said vessel having an annular inner wall between said tubular portion and said sleeve.

24. The toilet of claim 22, further comprising means for separably connecting said sleeve to said tubular portion.

25. The toilet of claim 11, wherein said vessel includes an annular inner wall which spacedly surrounds said pipe and has an upper end at a level at least close to the level of the upper end of said duct.

26. The toilet of claim 25, wherein the upper end of said inner wall abuts said intake in the open position of said valve.

27. The toilet of claim 25, wherein the upper end of said inner wall is disposed beneath said intake and beneath the maximum permissible level of the supply of liquid in said tank in the closed position of said valve.

28. The toilet of claim 11, wherein said moving means includes a manually operable component which is accessible at the exterior of said tank.

29. The toilet of claim 28, wherein said tank includes a cover and said manually operable component is accessible at the exterior of said cover and is movable in a direction toward the interior of said tank.

30. The toilet of claim 29, wherein said opening means includes a manually operated component which is mounted in and is accessible at the exterior of said cover.

31. The toilet of claim 1, further comprising means for varying the duration of opening of said valve.

* * * * *